US005450981A

United States Patent [19]

Fields

[11] Patent Number: 5,450,981

[45] Date of Patent: Sep. 19, 1995

[54] TOILET TISSUE DISPENSERS WITH PIVOTING HINGES

[76] Inventor: Willie Fields, 84 Sunny La., South Lebanon, Ohio 45065

[21] Appl. No.: 202,474

[22] Filed: Feb. 28, 1994

[51] Int. Cl.[6] ..... B65H 1/00

[52] U.S. Cl. ..... 221/33; 242/598.3

[58] Field of Search ..... 221/33; 242/598.2, 598.3, 242/599.3, 598

[56] References Cited

U.S. PATENT DOCUMENTS

| | | | |
|---|---|---|---|
| 2,374,586 | 4/1945 | Dessaur | 242/598.3 |
| 3,022,957 | 2/1962 | Blunt et al. | 242/598.2 |
| 4,483,491 | 11/1984 | Rainey | 242/598.3 |

*Primary Examiner*—Kenneth Noland

[57] ABSTRACT

A toilet tissue dispenser with pivoting hinges comprising a solid, generally planar wall plate with a front surface and a back surface. A first side plate has a flat back portion and interior and exterior faces. The first side plate also includes upper and frontal portions and is configured to attach to the front surface of the wall plate. The interior face of the first side plate includes a gradually enlarging groove angled upward at approximately 45 degrees to the wall plate, terminating in a centrally located spherical socket. A second side plate has a flat back portion and interior and exterior faces. The second side plate also includes upper and frontal portions and is configured to attach to the front surface of the wall plate. The second side plate is divided into front and rear portions at about a 45 degree angle upwardly with respect to the wall plate. The front portion is shaped in a generally semi-circular configuration. The rear portion is shaped in a generally triangular configuration. The front and rear portions are attached to each other along a parting line for rotation of the front portion in an outward direction opposite from the adjacent first side plate. A cylindrical dowel is centrally located on the interior face of the front portion of the second side plate. The dowel includes a rounded end which rests in the centrally located spherical groove when in the operative orientation. A hinge couples the front and rear portions of the second side plate.

4 Claims, 3 Drawing Sheets

FIG. 1
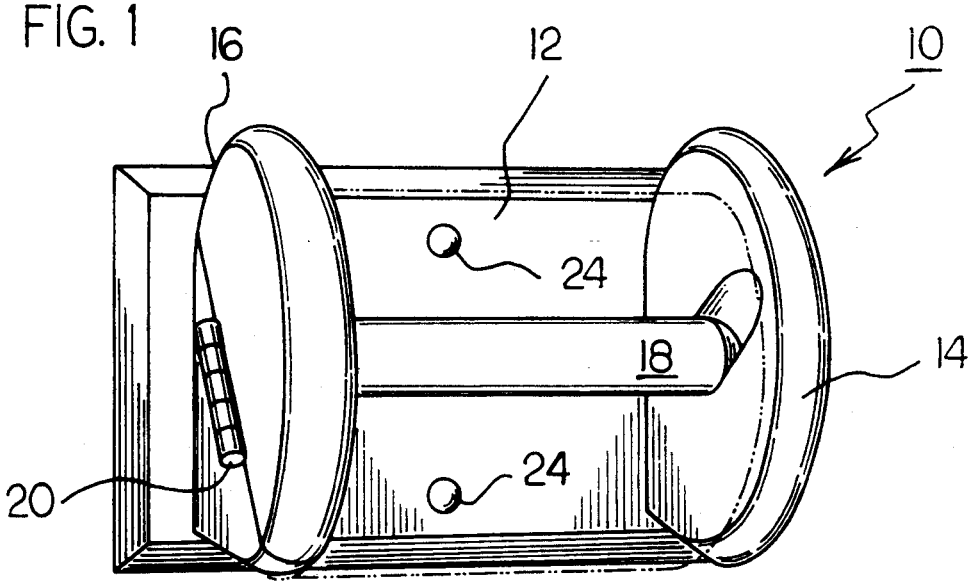
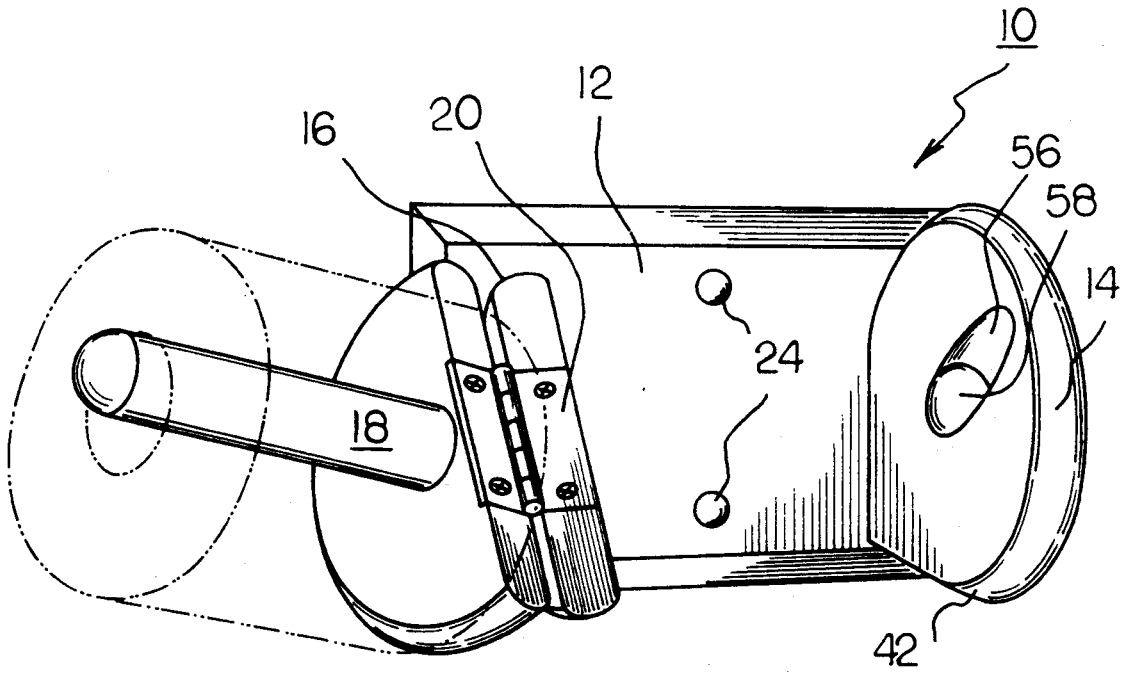
FIG. 2

TOILET TISSUE DISPENSERS WITH PIVOTING HINGES

BACKGROUND OF THE INVENTION

1. Field of the Invention

The present invention relates to toilet tissue dispensers with pivoting hinges and more particularly pertains to pivoting the hinged dowels of dispensers to replace toilet tissue rolls.

2. Description of the Prior Art

The use of toilet tissue dispensers is known in the prior art. More specifically, toilet tissue dispensers heretofore devised and utilized for the purpose of supporting, dispensing and replacing toilet tissue by way of a removable dowel are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 5,149,003 to Tharp, a toilet paper holder and paper towel holder.

U.S. Pat. No. 5,104,054 to Latham discloses a portable paper product dispenser.

U.S. Pat. No. 4,326,678 to Hamm discloses a toilet tissue holder.

U.S. Pat. No. 4,381,083 to Tsunetsugu discloses a toilet paper holder.

U.S. Pat. No. 4,513,923 to Ulics discloses a commode toilet tissue dispenser.

In this respect, the toilet tissue dispensers with pivoting hinges according to the present invention substantially departs from the conventional concepts and designs of the prior art, and in doing so provides an apparatus primarily developed for the purpose of pivoting the hinged dowels of dispensers to replace toilet tissue rolls.

Therefore, it can be appreciated that there exists a continuing need for new and improved toilet tissue dispensers with pivoting hinges which can be used for pivoting the hinged dowels of dispensers to replace toilet tissue rolls. In this regard, the present invention substantially fulfills this need.

SUMMARY OF THE INVENTION

In view of the foregoing disadvantages inherent in the known types of toilet tissue dispensers now present in the prior art, the present invention provides an improved toilet tissue dispenser with a pivoting hinge. As such, the general purpose of the present invention, which will be described subsequently in greater detail, is to provide a new and improved toilet tissue dispenser with a pivoting hinge and method which has all the advantages of the prior art and none of the disadvantages.

To attain this, the present invention essentially comprises a new and improved toilet tissue dispenser with a pivoting hinge including a solid, generally rectangular, planar wall plate with rounded edges. The wall plate including parallel short side edges and upper and lower long side edges, with the short side edges positioned vertically in the operative orientation. Three sets of apertures are located near the upper and lower edges of the long side edges, with two of the pairs proximate to the edges of the shorter sides and one of the pairs located equidistantly between them. A first side plate has a bottom portion with rounded edges and a completely flat back portion, such portions being contiguous with and perpendicular to each other. The first side plate has interior and exterior faces, including a generally circular upper and frontal portion with rounded edges. The first side plate is positioned to attach to the wall plate of the dispenser flush with the flat back portion. The upper portion of the interior side of the first side plate includes a gradually enlarging groove angled upward at approximately 45 degrees to the wall plate, terminating in a centrally located spherical socket. A second side plate has a bottom portion with rounded edges and a completely flat back portion, such portions being contiguous with and perpendicular to each other. The second side plate has interior and exterior faces, including a generally circular upper and frontal portion with rounded edges. The second side plate is positioned to attach to the wall plate of the dispenser flush with the flat back portion. The second side plate is divided into noncontiguous front and rear portions at about a 45 degree angle upwardly with respect to the wall plate. The rear portion is shaped in a generally triangular configuration with two rounded corners. The front portion is shaped in a generally semi-circle configuration. The front and rear portions are attached to each other along a parting line for rotation in an outward direction opposite from the adjacent first side plate. A cylindrical dowel is centrally located on the interior wall of the front portion of the second side plate, and includes a rounded end which rests in the centrally located spherical groove when in the operative orientation. A hinge couples the front and rear portions of the second side plate and consists of two equally sized, generally rectangular wings joined by a centrally located cylindrical pivot. Three sets of screws are utilized. Two sets are used to couple the side plates to the wall plate through the apertures located near the short side edges of the wall plate. One longer set is used to couple the wall plate to a mounting surface such as a bathroom wall through the centrally located apertures. Decorative wood plugs are positioned to cover the coupling means utilized in the centrally located apertures in the wall plate.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved toilet tissue dispensers with pivoting hinges which have all the advantages of the prior art toilet tissue dispensers and none of the disadvantages.

It is another object of the present invention to provide new and improved toilet tissue dispensers with pivoting hinges which may be easily and efficiently manufactured and marketed.

It is further object of the present invention to provide new and improved toilet tissue dispensers with pivoting hinges which are of durable and reliable constructions.

An even further object of the present invention is to provide new and improved toilet tissue dispensers with pivoting hinges which are susceptible of a low cost of manufacture with regard to both materials and labor, and which accordingly are then susceptible of low prices of sale to the consuming public, thereby making such toilet tissue dispensers with pivoting hinges economically available to the buying public.

Still yet another object of the present invention is to provide new and improved toilet tissue dispensers with pivoting hinges which provide in the apparatuses and methods of the prior art some of the advantages thereof, while simultaneously overcoming some of the disadvantages normally associated therewith.

Still another object of the present invention is to pivot the hinged dowels of dispensers to replace toilet tissue rolls.

Lastly, it is an object of the present invention to provide a toilet tissue dispenser with pivoting hinges comprising a solid, generally planar wall plate with a front surface and a back surface. A first side plate has a flat back portion and interior and exterior faces. The first side plate also includes upper and frontal portions and is configured to attach to the front surface of the wall plate. The interior face of the first side plate includes a gradually enlarging groove angled upward at approximately 45 degrees to the wall plate, terminating in a centrally located spherical socket. A second side plate has a flat back portion and interior and exterior faces. The second side plate also includes upper and frontal portions and is configured to attach to the front surface of the wall plate. The second side plate is divided into front and rear portions at about a 45 degree angle upwardly with respect to the wall plate. The front portion is shaped in a generally semi-circular configuration. The rear portion is shaped in a generally triangular configuration. The front and rear portions are attached to each other along a parting line for rotation of the front portion in an outward direction opposite from the adjacent first side plate. A cylindrical dowel is centrally located on the interior face of the front portion of the second side plate. The dowel includes a rounded end which rests in the centrally located spherical groove when in the operative orientation. A hinge couples the front and rear portions of the second side plate.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of the preferred embodiment of the toilet tissue dispensers with pivoting hinges constructed in accordance with the principles of the present invention.

FIG. 2 is a perspective view of the dispenser in the open position with a paper roll suspended on the dowel.

The same reference numerals refer to the same parts through the various Figures.

DESCRIPTION OF THE PREFERRED EMBODIMENT

Figure 3:
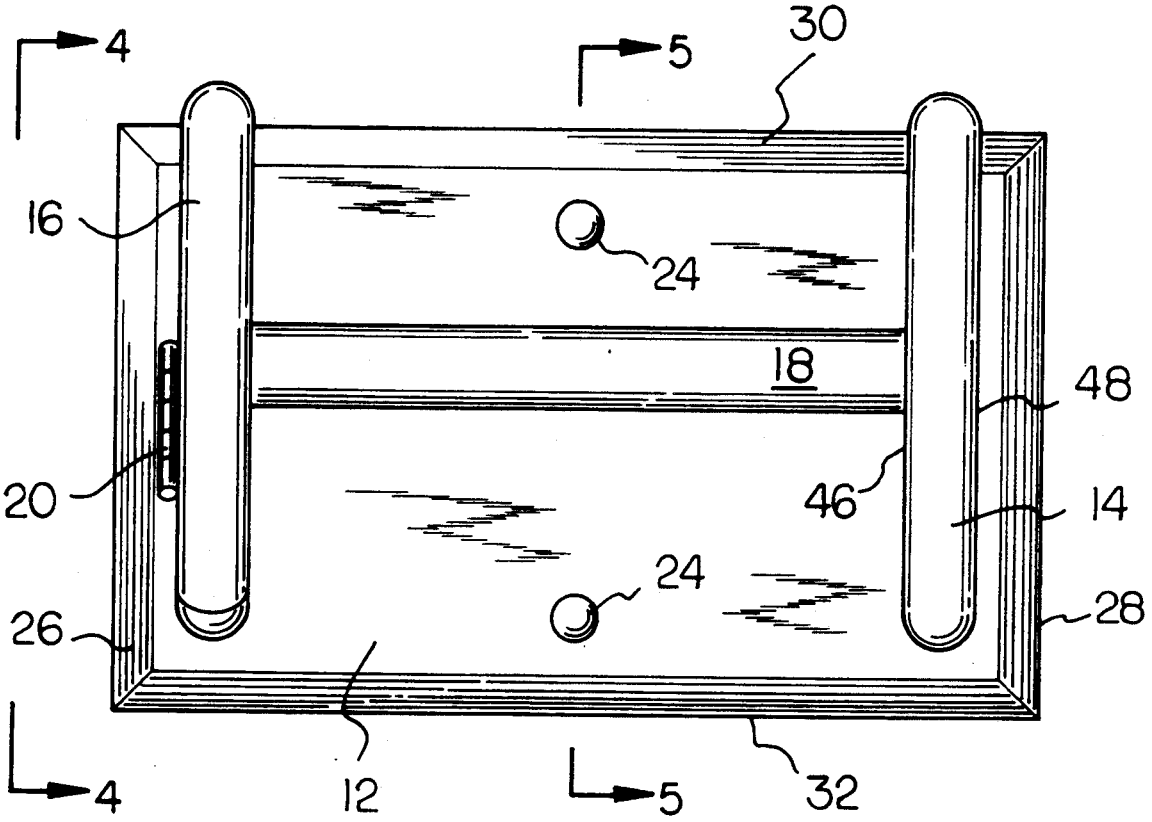
FIG. 3 is a front elevational view of the dispenser shown in FIG. 1.

With reference now to the drawings, and in particular to FIG. 1 thereof, the preferred embodiment of the new and improved toilet tissue dispensers with pivoting hinges embodying the principles and concepts of the present invention and generally designated by the reference numeral 10 will be described.

Specifically, it will be noted in FIGS. 1 through 4, that there is provided a new and improved a new and improved toilet tissue dispenser 10 with a pivoting hinge. The toilet tissue dispenser 10, in its broadest context, comprises a wall plate 12, a first side plate 14, a second side plate 16, a cylindrical dowel 18, a hinge 20, three sets of screws 21, 22 and 23, and decorative wood plugs 24.

More specifically, the wall plate 12 is comprised of a solid, generally rectangular, planar plate with rounded edges. The wall plate 12 includes parallel short side edges 26, 28, and upper and lower long side edges 30, 32, with the short side edges 26, 28 positioned vertically in the operative orientation. Three sets of apertures 34, 35 and 36 are located near the upper and lower edges of the long side edges 30, 32, with two of the pairs 34, 36 proximate to the edges of the shorter sides 26, 28 and one of the pairs 35 located equidistantly between them. The centrally located apertures 35 are positioned to allow the user to affix the dispenser to a mounting surface such as a bathroom wall or cabinet. Note in particular FIG. 3.

The second component of the toilet tissue dispenser 10 is a first side plate 14. The first side plate 14 has a bottom portion with rounded edges 42 and a completely flat back portion 44, such portions being contiguous with and perpendicular to each other. The first side plate 14 has interior and exterior faces 46, 48, including a generally circular upper 50 and frontal portion 52 with rounded edges. The first side plate 14 is positioned to attach to the wall plate 12 of the dispenser flush with the flat back portion 44. The upper portion 50 of the interior side 46 of the first side plate 14 includes a gradually enlarging groove 56 angled upward at approximately 45 degrees to the wall plate 12, terminating in a centrally located spherical socket 58. Note in particular FIGS. 2 and 5.

Figure 6:
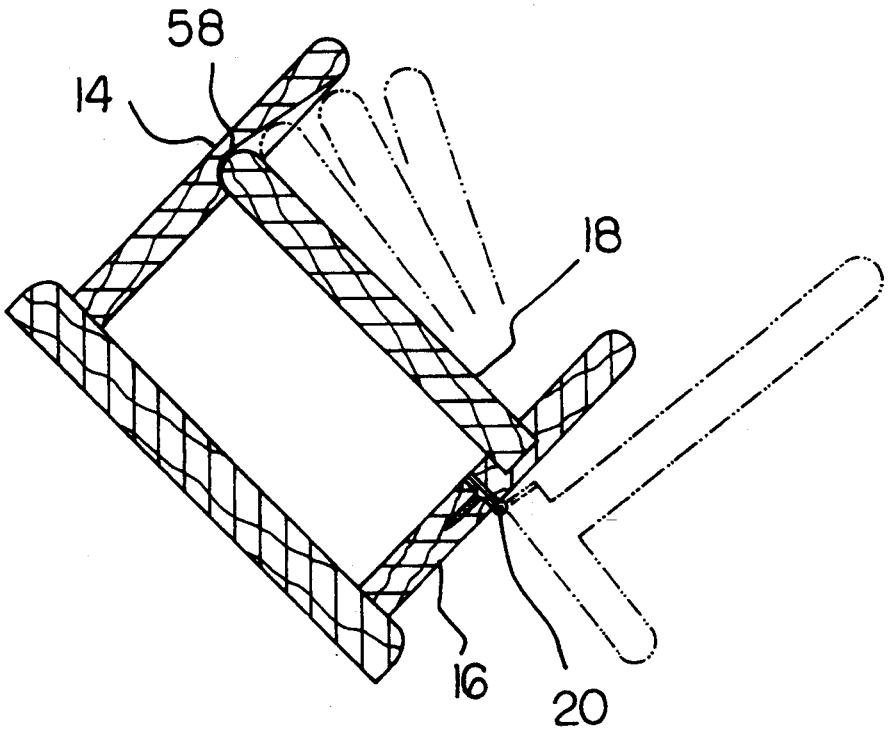
FIG. 6 is a cross sectional view taken along line 6—6 of FIG. 4.

The third component is a second side plate 16 which has a bottom portion with rounded edges 60 and a completely flat back portion 62, such portions being contiguous with and perpendicular to each other. The second side plate 16 has interior and exterior faces 64, 66, including a generally circular upper 68 and frontal portion 70 with rounded edges. The second side plate 16 is positioned to attach to the wall plate 12 of the dispenser flush with the flat back portion 71. The second side plate 16 is divided into noncontiguous front 72 and rear portions 74 at about a 45 degree angle upwardly with respect to the wall plate 12. The rear portion 74 is shaped in a generally triangular configuration with two rounded corners. The front portion 72 is shaped in a generally semi-circle configuration. The front 72 and rear 74 portions are attached to each other along a parting line 76 for rotation in an outward direction opposite from the adjacent first side plate 14. Note in particular FIGS. 2, 4, and 6.

The fourth component is a cylindrical dowel 78 which is centrally located on the interior face 64 of the front portion 72 of the second side plate 16, and includes a rounded end 80 which rests in the centrally located spherical socket 58 when in the operative orientation.

The fifth component is a hinge 20 which couples the front 72 and rear 74 portions of the second side plate 16 and consists of two equally sized, generally rectangular wings 82 joined by a centrally located cylindrical pivot 84.

Figure 4:
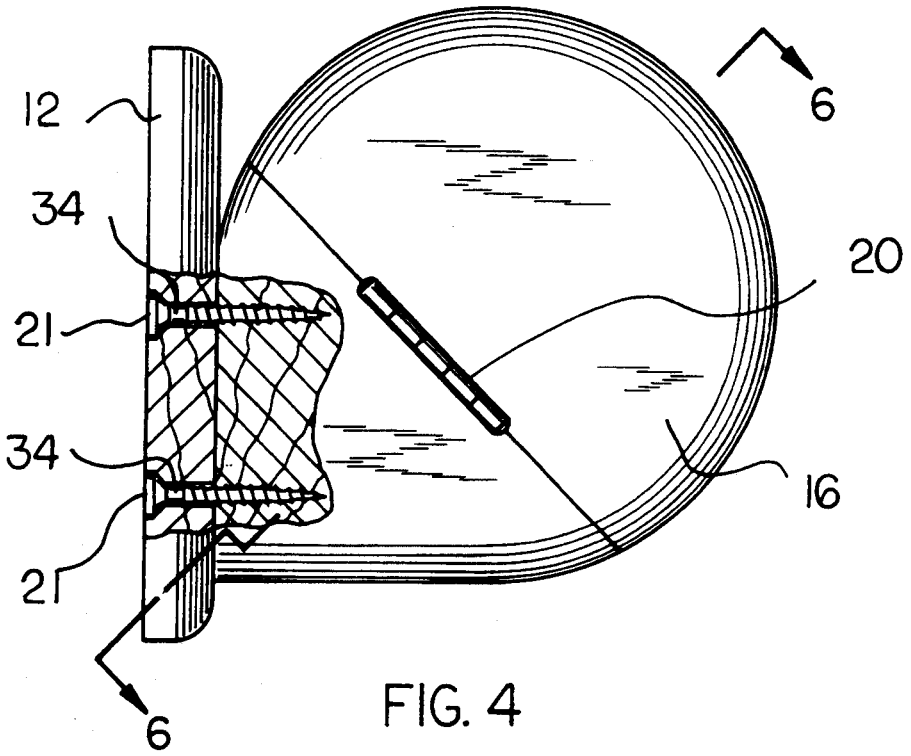
FIG. 4 is a side elevational view of the dispenser shown in FIG. 1, partially in section.
Figure 5:
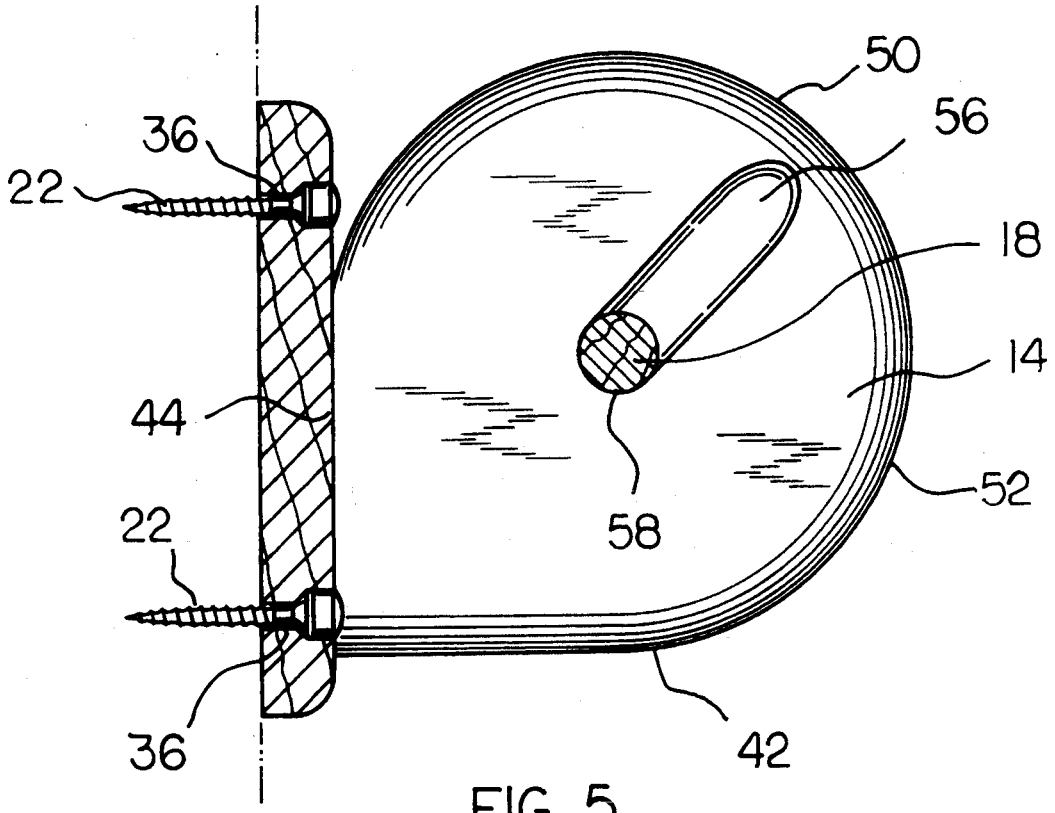
FIG. 5 is a cross sectional view taken along line 5—5 of FIG. 3.

As shown in FIGS. 4 and 5, three sets of screws are utilized 21, 22 and 23. Two sets 21, 23 are used to couple the side plates 14, 16 to the wall plate 12 through the apertures located near the short side edges of the wall plate 34, 36. One longer set 22 is used to couple the wall plate 12 to a mounting surface such as a bathroom wall through the centrally located apertures 35.

In FIGS. 1 and 5, decorative wood plugs 96 are positioned to cover the coupling means utilized in the centrally located apertures 35 in the wall plate 12. Note in particular FIGS. 1 and 5.

The toilet tissue dispenser with a flexible hinge was designed for both aesthetic beauty and ease of operation. The natural wood construction of the dispenser is compatible with a wide range of bathroom decors. The dispenser may be mounted on the bathroom wall or cabinet for easy access by the user. Decorative wood plugs are positioned to cover the coupling means utilized to mount the dispenser. In order to replace a toilet tissue roll the user simply pivots the dowel in a direction opposite from the adjacent side plate to place the dispenser in its open orientation with the dowel pointing outward. The user then easily replaces the old toilet tissue roll with a new one, and returns the dispenser to the closed, operative orientation by pivoting the dowel inward so that the point of the dowel rests securely in the centrally located spherical groove of the adjacent side plate.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new and improved toilet tissue dispenser with a pivoting hinge comprising, in combination:

a solid, generally rectangular, planar wall plate with rounded edges, including parallel short side edges and upper and lower long side edges, with the short side edges positioned vertically in the operative orientation, three sets of apertures located near the upper and lower edges of the long side edges with two of the pairs proximate to the edges of the shorter sides and one of the pairs located equidistantly between them;

a first side plate having a bottom portion with rounded edges and a completely flat back portion, such portions being contiguous with and perpendicular to each other, the first side plate having interior and exterior faces, including a generally circular upper and frontal portion with rounded edges, the first side plate designed to attach to the wall plate of the dispenser flush with the flat back portion, the upper portion of the interior side of the first side plate including a gradually enlarging groove angled upward at approximately 45 degrees to the wall plate, and terminating in a centrally located spherical socket;

a second side plate having a bottom portion with rounded edges and a completely flat back portion, such portions being contiguous with and perpendicular to each other, the second side plate having interior and exterior faces, including a generally circular upper and frontal portion with rounded edges, the second side plate positioned to attach to the wall plate of the dispenser flush with the flat back portion, the second side plate divided into noncontiguous front and rear portions at about a 45 degree angle upwardly with respect to the wall plate, the rear portion shaped in a generally triangular configuration with two rounded corners, a front portion shaped in a generally semi-circle configuration, the front and rear portions attached to each other along a parting line for rotation in an outward direction opposite from the adjacent first side plate;

a cylindrical dowel centrally located on the interior wall of the front portion of the second side plate, the dowel including a rounded end which rests in the centrally located spherical groove when in the operative orientation;

a hinge coupling the front and rear portions of the second side plate consisting of two equally sized, generally rectangular wings joined by a centrally located cylindrical pivot;

three sets of screws, two sets to couple the side plates to the wall plate through the apertures located near the short side edges of the wall plate, one longer set designed to couple the wall plate to a mounting surface such as a bathroom wall through the centrally located apertures; and decorative wood plugs positioned to cover the coupling means utilized in the centrally located apertures in the wall plate.

2. A toilet tissue dispenser with pivoting hinges comprising:

a solid, generally planar wall plate with a front surface and a back surface;

a first side plate having a flat back portion, the first side plate having interior and exterior faces, including upper and frontal portions, the first side plate configured to attach to the front surface of the wall plate, the interior face of the first side plate including a gradually enlarging groove angled upward at approximately 45 degrees to the wall plate, and terminating in a centrally located spherical socket;

a second side plate having a flat back portion, the second side plate having interior and exterior faces, including upper and frontal portions positionable in a plane, the second side plate configured to attach directly to the front surface of the wall plate, the second side plate being divided into front and rear portions at about a 45 degree angle upwardly with respect to the wall plate, the rear portion shaped in a generally triangular configuration, with the front portion shaped in a generally semi-circular configuration, the front and rear portions attached to each other along a parting line for rotation of the front portion in an outward direction opposite from the adjacent first side plate;

a cylindrical dowel centrally located on the interior face of the front portion of the second side plate, the dowel including a rounded end which rests in the centrally located spherical groove when in the operative orientation;

a hinge coupling the front and rear portions of the second side plate.

3. The toilet tissue dispenser as set forth in claim 2 and further including:

three sets of screws, two sets to couple the side plates to the wall plate through the apertures located near the short side edges of the wall plate, one longer set designed to couple the wall plate to a mounting surface such as a bathroom wall through additional apertures.

4. The toilet tissue dispenser as set forth in claim 2 and further including:

decorative wood plugs positioned to cover the coupling means utilized to affix the wall plate to a mounting surface.

* * * * *